United States Patent [19]

Gilman, Jr. et al.

[11] 4,243,738

[45] Jan. 6, 1981

[54] AMPLIFICATION PROCESS

[75] Inventors: Paul B. Gilman, Jr., Pittsford; Jan R. Haase, Rochester, both of N.Y.

[73] Assignee: Eastman Kodak Company, Rochester, N.Y.

[21] Appl. No.: 35,161

[22] Filed: May 2, 1979

[51] Int. Cl.[3] ..... G03C 5/32

[52] U.S. Cl. ..... 430/202; 430/213; 430/394; 430/434; 430/203; 430/237; 430/238

[58] Field of Search ..... 430/202, 213, 238, 237, 430/394, 434, 223, 203

[56] References Cited

U.S. PATENT DOCUMENTS

| | | | |
|---|---|---|---|
| 3,796,579 | 3/1974 | Brooker | 96/94 R |
| 3,980,479 | 9/1976 | Fields | 96/3 |
| 4,053,312 | 10/1977 | Fleckenstein | 430/223 |
| 4,055,428 | 10/1977 | Koyama et al. | 96/73 |
| 4,076,529 | 2/1978 | Fleckenstein et al. | 96/3 |
| 4,139,379 | 2/1979 | Chasman et al. | 96/3 |

FOREIGN PATENT DOCUMENTS

| | | | |
|---|---|---|---|
| 1464104 | 2/1977 | United Kingdom | 96/3 |
| 1464105 | 2/1977 | United Kingdom | 96/3 |

*Primary Examiner*—Won H. Louie, Jr.
*Attorney, Agent, or Firm*—Joshua G. Levitt

[57] ABSTRACT

A process for amplifying an imagewise exposure of a silver halide photographic element comprises the steps of (a) developing the element to release spectral sensitizing dye from a release compound as a function of silver halide development; (b) adsorbing the spectral sensitizing dye to undeveloped silver halide grains; (c) exposing the element overall to radiation absorbable by released spectral sensitizing dye to render developable silver halide grains to which the released spectral sensitizing dye has been adsorbed and (d) developing silver halide grains.

10 Claims, No Drawings

AMPLIFICATION PROCESS

This invention relates to a process of amplifying an imagewise exposure of a photographic element.

Normally photographic silver halide emulsions have a fixed exposure latitude which typically is about 2 to 3 stops. Such materials therefore must be correctly exposed. While moderate under- or over-exposure can be compensated for in processing, particularly with negative materials, drastic under- or over-exposure results in an unusable image.

Various techniques are known for compensating during processing for under-exposure, thereby increasing the effective speed of the photographic emulsion. One such technique is described in Brooker and Gilman U.S. Pat. No. 3,796,579 issued Mar. 12, 1974. This patent describes a photographic material containing a silver halide emulsion and a colorless precursor of a spectral sensitizing dye. During development the precursor is oxidized to a sensitizing dye and becomes adsorbed to nearby silver halide grains. Re-exposure of the element to light of a wavelength to which only the sensitized grains respond, followed by re-development of the element, results in amplification of the original image.

We have found a process for amplifying an imagewise exposure employing release compounds which release a spectral sensitizing dye as a function of silver halide development.

In accordance with our invention there is provided a process of amplifying an imagewise exposure of a photographic element containing an imagewise exposed silver halide emulsion layer having associated therewith a release compound capable of releasing a spectral sensitizing dye as a function of silver halide development, the process comprising the steps of:

(a) developing the element to release spectral sensitizing dye as a function of silver halide development;

(b) adsorbing the spectral sensitizing dye to developed silver halide grains;

(c) exposing the element overall to radiation from a region of the spectrum which is adsorbed by the released spectral sensitizing dye to render developable silver halide grains to which the released spectral sensitizing dye has been adsorbed; and (d) developing silver halide grains rendered developable in step (c).

During first development (step (a)) spectral sensitizing dye is released. Since exposure does not render all grains in an exposed area developable, there exist in areas where spectral sensitizing dye is released, undeveloped silver halide grains to which dye can migrate and be adsorbed. Thus in one embodiment the released dye is allowed to migrate and be adsorbed to undeveloped grains in the exposed silver halide emulsion layer. In this embodiment it is preferred that the release compound be in the same layer as the silver halide emulsion.

Alternatively, the released dye can be allowed to migrate to a separate silver halide emulsion layer which is on the same support or on a different support and be adsorbed to silver halide grains in that layer. In this embodiment it is preferred that the release compound be in a separate layer from the initially exposed silver halide emulsion, and that this layer be so located that development products of silver halide development can migrate thereto. Similarly, the silver halide emulsion layer to which the released dye is to migrate should be in a location with respect to the layer containing the release compound which will facilitate migration of the released dye. If this receiving silver halide emulsion layer is coated on the same support as the exposed emulsion layer, it can be separated therefrom by a filter layer which will prevent its exposure during imagewise exposure of the element. If the receiving silver halide emulsion layer is coated on a different support, it can be brought into contact with the exposed element after exposure but prior to termination of the first development.

Once dye is adsorbed to the undeveloped silver halide grains, there is formed in the layer containing these grains an imagewise distribution of spectrally sensitized grains corresponding to release of spectral sensitizing dye during the first development step. These grains differ from other grains in the layer in that they can be rendered developable by a spectrally selective exposure to light absorbed by the spectral sensitizing dye. Thus, overall exposure of the element to light of a wavelength which is absorbed only by the spectrally sensitized grains forms a developable latent image.

The second development (step (d)) causes development of those grains to which dye has been adsorbed and which have received sufficient exposure to form a developable latent image. This results in amplification of the original exposure and an increase in the effective speed of the element.

The steps of this process can be performed in the sequence enumerated and described above as separate, discrete steps. Alternatively, the spectrally selective overall exposure (step (c)) can be performed during the first development (step (a)) so that the second development (step (d)) represents a continuation of the first development (step (a)).

The release compound can be one which releases the spectral sensitizing dye as a direct function of silver halide development. These are referred to herein as negative-working release compounds. Alternatively, the release compound can be one which releases the spectral sensitizing dye as an inverse function of silver halide development. These are referred to herein as positive-working release compounds.

A preferred class of negative-working release compounds are the ortho or para sulfonamidophenols and naphthols described in U.S. Pat. Nos. 4,053,312, 4,055,428 and 4,706,529. In these compounds the spectral sensitizing dye moiety is attached to a sulfonamido group which is ortho or para to the phenolic hydroxy group and is released by hydrolysis after oxidation of the sulfonamido compound during development.

A preferred class of positive-working release compounds are the nitrobenzene and quinone compounds described in U.S. Pat. No. 4,139,379. In these compounds the spectral sensitizing dye moiety is attached to an electrophilic cleavage group, such as a carbamate group, ortho to the nitro group or the quinone oxygen, and is released upon reduction of the compound by an electron donor compound contained in the element or the developer composition, unless the electron donor is oxidized during development.

Other useful positive-working release compounds are the hydroquinones described in U.S. Pat. No. 3,980,479 and the benzisoxazolone compounds described in U.K. Pat. Nos. 1,464,104 and 1,464,105.

Further details regarding the above release compounds, the manner in which they function, and the procedures by which they can be prepared are contained in the patents referred to above, the disclosures of which are hereby incorporated by reference.

The spectral sensitizing dyes released from the release compounds are preferably merocyanine or cyanine dyes. Such dyes comprise two heterocyclic nuclei joined by a carbon atom chain having alternating double and single bonds which form a part of the conjugated carbon atom chain which joins the terminal hetero atoms of the dye chromophore. In the case of cyanine dyes the terminal hetero atoms are each nitrogen atoms. In the case of merocyanine dyes, one of the terminal hetero atoms is a nitrogen atom and the other terminal hetero atom is an oxygen atom. The spectral sensitizing dye moiety can be joined to the sulfonamido or carbamate group of the release moiety through an alkylene link between that group and the terminal hetero atom of the dye chromophore or another atom in the dye.

The spectral sensitizing dyes can contain solubilizing groups, such as acid groups, which will aid their migration to adjacent emulsion layers in the alkaline environment present during development.

The light sensitive silver halide emulsions employed in this invention can include coarse, regular or fine grain silver halide crystals, or mixtures thereof. The emulsions can be negative-working emulsions or, in certain embodiments, direct positive-emulsions. They can form latent images predominantly on the surface of the silver halide grains or predominantly in the interior of the silver halide grains. They can be chemically sensitized and spectrally sensitized in accordance with usual practice.

As indicated above, the release compound can be in the emulsion layer or in an adjacent layer. If the silver halide and the release compound are in the same layer, and the released sensitizing dye is not to be transferred to another silver halide emulsion layer, both the silver halide emulsion and the release compound should be negative-working. If, however, the sensitizing dye is to be transferred to a receiving silver halide emulsion layer, each of (a) the silver halide emulsion which is to receive imagewise exposure, (b) the release compound and (c) the receiving silver halide emulsion to which the released sensitizing dye is transferred, can be either negative-working or positive-working. Depending upon which of the various possible combinations are selected, either a positive image or a negative image will be obtained in the receiving silver halide emulsion layer.

If the emulsion to be imagewise exposed is spectrally sensitized, it should be sensitized to a region of the spectrum different from that absorbed by the released spectral sensitizing dye.

In photographic elements usefully processed in accordance with this invention, the silver halide emulsion can be coated at a coverage of about 0.10 to 10 grams per square meter and the release compound coated at a coverage of from about 5 milligrams per square meter to about 80 milligrams per square meter, preferably from about 20 milligrams per square meter to about 40 milligrams per square meter.

The photographic elements processed in accordance with this invention can contain additional layers conventional in photographic elements, such as spacer layers, filter layers, antihalation layers, scavenger layers and the like. The support can be any suitable support used for photographic elements. Typical supports include polymeric films, paper (including polymer coated paper), glass and the like.

The developer compositions with which the elements are processed are aqueous alkaline solutions containing developing agents which will operate to release the spectral sensitizing dye. Suitable developing agents include hydroquinones, aminophenols, and pyrazolidones. If the developing agent is not an electron donor, as defined in U.S. Pat. No. 4,139,379, referred to above, then a separate electron donor, as described therein, should be contained in the developer compositions intended for use with the preferred positive-working release compounds, or such an electron donor should be contained in the element.

The developer compositions, additionally can contain other conventional addenda such as pH modifiers, activators, development restrainers, and the like.

After the second development the element is fixed to remove undeveloped silver halide, washed and dried.

Preferred release compounds for use in elements processed in accordance with this invention are as follows:

Release Compound A

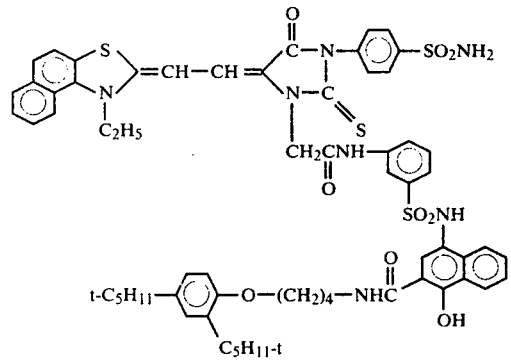

Release Compound B

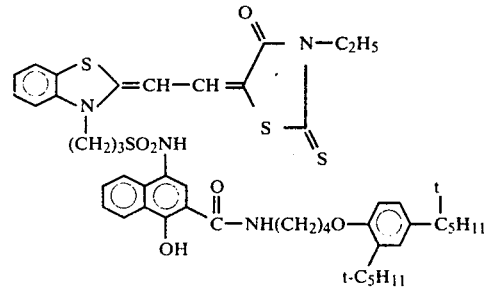

Release Compound C

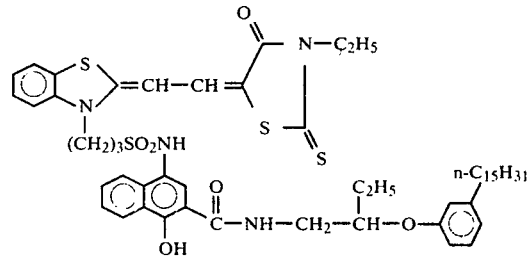

The following examples further illustrate this invention.

EXAMPLE 1

A dispersion was made by adding 103 mg of Release Compound A to 10 cc of the solvent N,n-butylacetanilide. The solution was added to 100 g of a 12.5 aqueous solution of gelatin containing 2 cc of 10% solution of the surfactant Alkanol XC. The mixture was stirred for 5 minutes at 50° C. then run through a colloid mill set at 0.025 cm five times. The final dispersion (11% gelatin) was adjusted to give 1 mg of Release Compound A per gram of dispersion.

A coating was made by mixing 10.14 g of a 0.2 μm cubic silver bromoiodide emulsion (sulfur and gold sensitized) with 34.5 g of a 12.5% aqueous gelatin solution, adding 121.5 g of distilled water, 60 g of the dispersion described above, 3.0 g of 15% saponin solution and 0.3 g of a 10% formaldehyde solution. The coating was made on subbed polyethylene terephthalate film support at a level of 1.16 g of silver per square meter, 8.2 g gel per square meter and 43 mg of release compound per square meter.

Exposure and Testing

The coating prepared as described above was exposed in a Bausch and Lomb wedge spectrograph for 1/100 of a second at a slit width of 0.5 mm, then processed by using a pod and a silver bromide receiving sheet. The pod used contained:

NaOH: 40 g
4-Hydroxymethyl-3-methyl-1-phenyl-3-pyrazolidone: 4 g
Hydroxyethylcellulose: 25 g The receiving sheet contained a 0.5 μm cubic grain silver bromide emulsion coated to give a silver coverage of 2.69 g per square meter and 5.38 g of gelatin per square meter. Processing was accomplished by rupturing the pod by passing the two sheets through a pair of steel rollers. After a 15 second contact the two layers were stripped apart and the silver bromide layer was then exposed for 1 second to a 25 watt bulb 46 cm away which was filtered with a Kodak Wratten 16 filter which limited the exposure to the region of absorption of the transferred dye. The strip was then developed for 2 minutes in Kodak Developer D-19. A high speed, low contrast negative was obtained in the donor layer and a 1.0 log E higher speed and higher contrast duplicate negative was obtained in the silver bromide receiver layer.

Similar results were obtained when the two layers were given the second exposure to minus blue light while still in contact, then stripped apart and a second development given to the receiver layer.

EXAMPLE 2

A dispersion was prepared by mixing the following components thoroughly at 40° C.:

Release Compound B: 25 mg
2-Phenoxyethanol: Enough to dissolve Release Compound B
Aqueous gelatin solution (12.5%): 220 g
Aqueous solution of the surfactant Alkanol XC (10%): 10 ml
Distilled water to a total weight of: 452 g A photosensitive coating formulation was prepared as follows:

Gelatin peptized AgBrI (3.5 mole %I) emulsion (0.6 Kg emulsion/mole Ag, 40 g gel/mole Ag): 18.4 g
Aqueous gelatin solution (12.5% by weight): 50.4 g
Aqueous saponin solution (15.4% by weight): 1.4 g
Dispersion prepared above: 35 g
Distilled water to a total weight of: 140.7 g and coated on a film support at 3.77 g Ag/m$^2$ and 20 mg release compound/m$^2$. The dried coating was exposed for 1/200 second on a Bausch and Lomb spectrograph (0.5 mm slit width) and processed by using a pod and an undyed silver bromoiodide receiving sheet (prepared as above but omitting the dispersion). The pod contained:

Sodium hydroxide 40 g
4-Hydroxy-3-methyl-1-phenyl-3-pyrazolidone: 4 g
Hydroxyethylcellulose: 25 g
Distilled water to: 1 liter Further processing was accomplished as described in Example 1. Essentially the same results were obtained as in Example 1.

EXAMPLE 3

A coating was prepared as described in Example 2 except that Release Compound C was added as a latex dispersion prepared by the following method:

Release Compound C (100 mg) was dissolved in a minimum amount of cyclohexane dimethanol-di-2-ethylhexanoate and then added to an aqueous latex solution of poly(n-butylacrylate-co-2-acrylamido-2-methylpropane-1-sulfonic acid, sodium salt-co-2-acetoacetoxyethylmethacrylate) (weight ratio 85:10:5). After mixing, the solvent was evaporated; the mixture was filtered and 84.6 g of 12.5% aqueous gelatin added. Distilled water was added to give a total dispersion weight of 180 grams.

This dispersion (35.0 g) was added to a silver halide emulsion and coated, both as described in Example 2 and processed as in Example 1 using the following pod formulation:

Sodium hydroxide: 60.0 g
4-Hydroxy-3-methyl-1-phenyl-3-pyrazolidone: 6.0 g
5-Methylbenzotriazole: 0.4 g
Hydroxyethylcellulose: 25.0 g
Distilled water to: 1.0 liter Similar results were obtained as in Example 1.

This invention has been described in detail with particular reference to preferred embodiments thereof, but it will be understood that variations and modifications can be effected within the spirit and scope of the invention.

We claim:

1. A process for amplifying an imagewise exposure of a photographic element containing an imagewise exposed silver halide emulsion layer having associated therewith a release compound capable of releasing a spectral sensitizing dye as a function of silver halide development, the release compound being selected from the group consisting of ortho and para sulfonamidophenol and naphthol release compounds, nitrobenzene release compounds, quinone release compounds, hydroquinone release compounds and benzisoxazolone release compounds, the process comprising the steps of:

(a) developing the element to release spectral sensitizing dye as a function of silver halide development;
(b) adsorbing the spectral sensitizing dye to undeveloped silver halide grains;
(c) exposing the element overall to radiation from a region of the spectrum which is absorbed by the released spectral sensitizing dye to render developable silver halide grains to which the released spectral sensitizing dye has been absorbed; and (d) developing silver halide grains rendered developable in step (c).

2. A process of claim 1 wherein the undeveloped silver halide grains are in the exposed silver halide emulsion layer.

3. A process of claim 1 wherein the separate layer is on a separate support and is associated with the exposed silver halide layer prior to or during development step (a).

4. A process of claim 1 wherein the exposed silver halide emulsion layer is spectrally unsensitized.

5. A process of claim 1 wherein the exposed silver halide emulsion layer is spectrally sensitized with a dye which absorbs radiation in a region of the spectrum different from that absorbed by the released spectral sensitizing dye.

6. A process of claim 1 wherein overall exposure step (c) is effected during development step (a), and development step (d) is a continuation of development step (a).

7. A process of claim 1 wherein the release compound is an ortho or para sulfonamidophenol or sulfonamidonaphthol release compound having a spectral sensitizing dye joined to the sulfonamido group.

8. A process of claim 7 wherein the spectral sensitizing dye is a merocyanine dye.

9. A process of claim 7 wherein the spectral sensitizing dye is a cyanine dye.

10. A process for amplifying an imagewise exposure of a photographic element containing an imagewise exposed silver halide emulsion layer having associated therewith a release compound capable of releasing a spectral sensitizing dye as a function of silver halide development, the release compound being selected from the group consisting of ortho and para sulfonamidophenol and naphthol release compounds, nitro-benzene release compounds, quinone release compounds, hydroquinone release compounds and benzisooxazolone release compounds, the process comprising the steps of:

(a) developing the element to release spectral sensitizing dye as a function of silver halide development;

(b) allowing the released spectral sensitizing dye to migrate to a separate silver halide emulsion layer and be adsorbed to undeveloped silver halide grains in said separate layer;

(c) exposing the separate layer overall to radiation from a region of the spectrum which is absorbed by the released spectral sensitizing dye to render developable silver halide grains to which the released spectral sensitizing dye has been adsorbed; and (d) developing silver halide grains rendered developable in step (c).

* * * * *